United States Patent [19]

Evans et al.

[11] Patent Number: 4,917,363

[45] Date of Patent: Apr. 17, 1990

[54] THERAPEUTIC HEADREST

[76] Inventors: Sherry J. Evans; Mary J. Jones, both of 8524 S. Wallace Ave., Chicago, Ill. 60620

[21] Appl. No.: 217,487

[22] Filed: Jul. 11, 1988

[51] Int. Cl.[4] ..... A61G 13/00

[52] U.S. Cl. ..... 269/328; 5/437; 5/440

[58] Field of Search ..... 269/328; 5/181, 184, 5/434, 435, 436, 437, 440

[56] References Cited

U.S. PATENT DOCUMENTS

| | | | |
|---|---|---|---|
| 1,211,871 | 1/1917 | Peoples | 5/440 |
| 2,461,744 | 2/1949 | Lafield | 5/436 |
| 2,634,435 | 4/1953 | Budd | 5/435 |
| 3,608,103 | 9/1971 | Seid | 5/72 |

FOREIGN PATENT DOCUMENTS

| | | | |
|---|---|---|---|
| 481498 | 8/1929 | Fed. Rep. of Germany | 5/440 |
| 2444458 | 8/1980 | France | 5/435 |

*Primary Examiner*—Judy J. Hartman

*Attorney, Agent, or Firm*—McAndrews, Held & Malloy

[57] ABSTRACT

A therapeutic headrest is provided for substantially reversing the normal pulling of facial muscles and tissues caused by gravitational forces. The headrest includes a body support for supporting a person in the supine position, and a head support to support a person's head at an elevation to effect the reversal of gravitational forces. The head support is adjustable to accommodate the physical characteristics of a person using the headrest.

3 Claims, 2 Drawing Sheets

THERAPEUTIC HEADREST

BACKGROUND OF THE INVENTION

A. Field of Invention

This invention relates to a novel apparatus to assist in substantially reversing the normal downward pulling of facial muscles and tissues caused by gravitational forces. More particularly, the invention provides for an adjustable and flexible therapeutic headrest capable of supporting a person's head in such a manner that gravity exerts a force on the facial muscles and tissues in a direction pointing toward the crown of the person's head.

B. Prior Art

When an individual is in an upright position with the head facing forward, gravity exerts a constant force on the facial muscles and tissues. The downward pulling on the facial muscles and tissues cause the skin to stretch. Stretched skin has the tendency to sag and look aged. If stretching of the skin could be inhibited, less sagging would occur and the facial tissues would have a more youthful appearance. To this end then it is desirable to minimize the normally downward pulling on facial muscles and tissues and even more desirable to completely reverse the direction of the forces exerted by gravity. A logical means to accomplish this goal is to invert the head so that gravity exerts a force in the direction pointing toward the crown of the head. The "crown" being defined as the top portion of the head.

The art recognizes a multitude of devices for supporting the head or reclining the upper body. The primary purpose of these devices is therapeutic. For example, U.S. Pat. No. 2,715,557 (Rock) discloses an adjustable headrest for chiropractic treatment. The headrest is designed for use with tables, benches and the like, wherein the nape and the back of the head are supported substantially along the horizontal line of a table or bench attached thereto. U.S. Pat. No. 3,601,122 (Guertin) discloses a postural drainage assistor to facilitate drainage of fluids from a person's lungs. This device can be used on conjunction with a bed where a patient, lying on his stomach, is extended over the edge of the bed so that the head and shoulders protrude diagonally downward. The Guertin device is used to comfortably support the head and shoulders. A similar device, designed to provide more restful sleep, is disclosed in U.S. Pat. No. 3,608,103 (Seid). This device is used at the edge of a bed, where a person lies on his stomach with his head protruding horizontally outward at an elevation equal to the surface of the bed. The head is supported by the device, which is positioned at a distance from the edge of the bed sufficient to allow the arms to extend downwardly to rest on an elbow support which is positioned below the surface of the bed.

Pillow type headrests have also been disclosed for use in supporting the body in a raised or semi-reclining position. For example, U.S. Pat. No. 3,648,308 (Greenawalt) discloses an elevated traction pillow for supporting the back, neck, and head to provide extended comfort for a bed ridden patient. This pillow has a triangular configuration, a head-receiving member secured proximate to the apex of the triangular configuration and a raised portion for supporting the neck. Similarly, U.S. Pat. Nos. 3,753,264 (Grenier) and 3,842,453 (Redfield) both disclose pillow type articles for use as therapeutic devices. The '264 patent provides for a resilient slant pillow that exerts a constant upward force to counteract the downward pull of facial skin. This upward force relieves scalp tension. The '354 patent discloses an elongated cylindrical flexible pillow having a rigid core.

Other devices are disclosed in the art for use primarily as convenience products. For example, U.S. Pat. No. 3,480,976 (Yavner) and the references cited therein, teach the use of a headrest in lieu of a pillow for feminine use during the hours of repose when the hair may be rolled on curlers.

While the device shown in each of the above mentioned prior art references may function quite well in the attainment of the objectives contemplated therein, in no instance have the references addressed or adequately solved the problem of sagging facial tissue. The headrest for reversing the normal downward pulling caused by gravitational forces herein disclosed is, therefore, deemed to adequately fill a need not previously addressed by the prior art.

SUMMARY OF THE INVENTION

To reiterate, this invention is directed towards a therapeutic device, more specifically to a therapeutic headrest where the crown of a head is supported in such a manner that the gravitational forces exerted on the facial muscles and tissues is substantially reversed. Reversal of the gravitational forces exerted on the facial muscles and tissues occurs when the crown of a head is tilted backwards 180 degrees from the position it occupies when an individual is in the normal upright vertical position. Alternatively, reversal of gravitational forces occurs when the crown of the head is tilted backwards 90 degrees from the position it occupies when a person is in the supine position.

It is an object of this invention to provide a therapeutic headrest having a head support means for use in combination with a horizontal body support to inhibit facial aging and to maintain a youthful appearance.

Another object of the invention is to provide a therapeutic headrest to be used by patients recently having undergone facial reconstruction to elevate the downward stretching of facial tissues.

Yet another object is to provide a therapeutic headrest to relieve the pain cause by pinched nerves of the cervical vertebrae without the use of a cumbersome neck collar.

Still another object of the invention provides a therapeutic headrest that aids in the correction of poor posture and that easily stores underneath a bed or within a means for body support.

Accordingly, in a broad embodiment, the invention is a therapeutic headrest for a person having a body, a head, a face and general physical characteristics, wherein the headrest comprises, in combination, body support means for supporting said body of said person in a supine position at a first predetermined elevation, head support means for supporting said head of said person at a second predetermined elevation below said first predetermined elevation such that normal gravitational forces upon said face are substantially reversed, said head support means including adjustment means for altering said second predetermined elevation, and alignment means for aligning said head support means with said body support means so as to accommodate said general physical characteristics of said person.

In an alternate embodiment the invention comprises four vertically positioned adjustable legs, two horizontal frame members each perpendicularly connected to the top end of two of the legs, a plate interposed with two of the adjustable legs, the plate having a plurality of connectors, a connector bar having a mount projecting horizontally outward for attachment to a body support, the connector bar interposed with two of the legs, and a flexible head support conformable to the shape of the crown of a head, the head support having one end fastened to one of the frame members and the other end attachable to the plate.

In another alternate embodiment the invention comprises a therapeutic headrest having a body support, in side view, of substantially triangular configuration and head support projecting outwardly from the base of said triangular configuration, said head support having a concave central portion located below the apex of the triangular configuration to allow the crown of a head to be placed within the concave central portion.

A more complete appreciation of the invention and many of the intended advantages thereof will be readily apparent as the same becomes better understood by reference to the following detailed description when considered in connection with the accompanying drawings.

BRIEF DESCRIPTION OF THE DRAWINGS

FIG. 5 displays one embodiment of vertical adjustability.

DESCRIPTION OF PREFERRED EMBODIMENT

Figure 5:
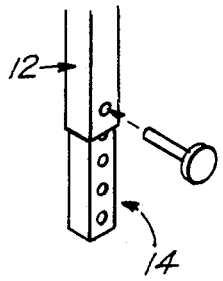
FIG. 5 is a partial prospective view taken along the line 5 indicated in FIG. 1.

Referring now to the drawings wherein like reference numerals designate the same or identical parts throughout several views and more specifically to FIGS. 1–4, there is shown a therapeutic headrest generally designated by reference numeral 11, intended for use in combination with a bed or other means for body support. The headrest includes head support means, adjustment means, and alignment means. An inflatable cushion, flexible sling member, molded plastic or rubber pillow or other similar devices known to the art may be used as the head support means. The adjustment means is necessary to allow alteration of the position of a person such that the normal gravitational forces exerted upon the facial muscles and tissues are substantially reversed. Adjustment means include any mechanical device for increasing or decreasing the tension associated with the head support means. For example, if a pneumatic cushion is used, an air means, such as a valve, may be provided to selectively increase or decrease the pressure within the cushion. If a flexible sling member is provided then a series of locking tabs adapted to interlock with a frame member supporting the sling may be provided. Alignment means may include wheels, castors, adjustable legs, or any other means known to the art for aligning the head support means so as to accommodate the physical characteristics of a person using the headrest.

Figure 1:
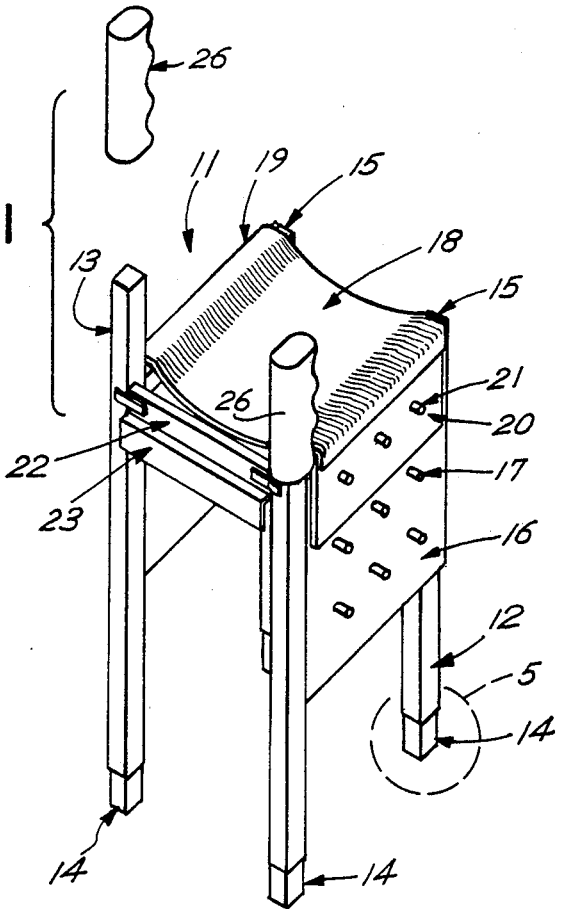
FIG. 1 is a perspective view of one embodiment of the invention, illustrating a head support attached to a frame supported by four adjustable legs having a mount for attachment to a means for body support.

In FIG. 1 headrest 11 includes four legs 12 each having a top end 13 and a bottom adjustable end 14. The adjustable ends 14 allow the headrest 11 to be raised or lowered, thus conforming to any type of body support means or to the physical characteristics of the individual utilizing the headrest 11. The adjustable ends 14 may include telescopic members, concentric members, or any means known to the art to provide variable length, see FIG. 5.

Attached to the top ends 13 are two horizontal frame members 15 aligned perpendicular to the legs 12, each frame member 15 connecting two legs. The legs 12 and frame members 15 may be constructed either of wood or of a light, strong, and ductile metal such as, aluminum.

Figure 2:
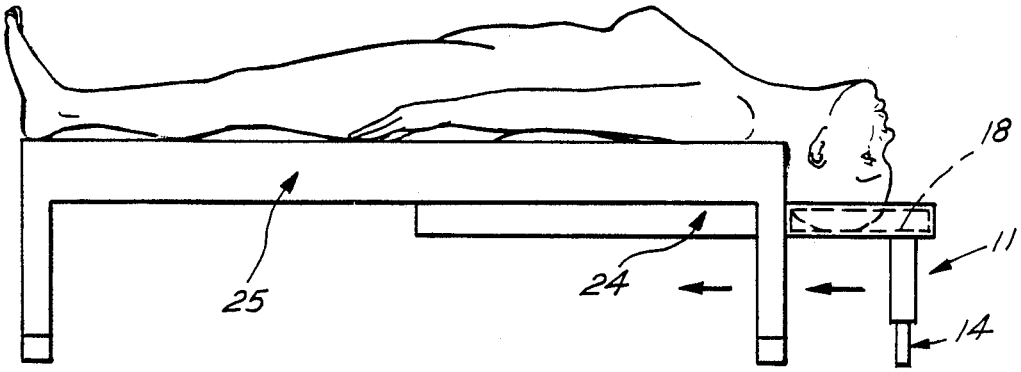
FIG. 2 is a side view of the invention in use in conjunction with a means for body support.
Figure 3:
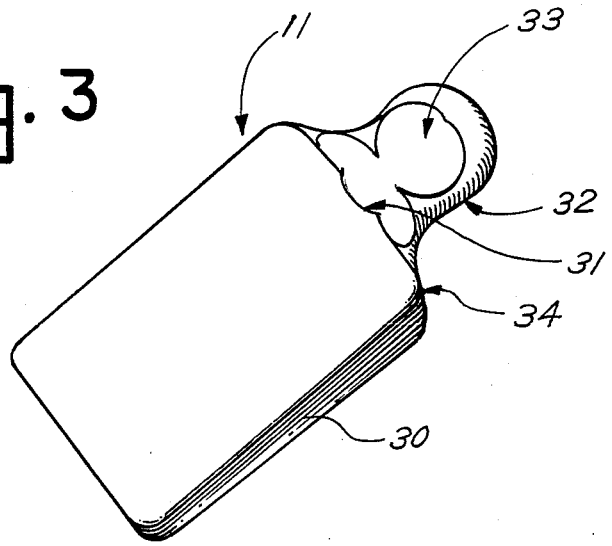
FIG. 3 is a perspective view of an alternate embodiment of the invention, illustrating a headrest of triangular configuration having a head-receiving member projecting outward from the base.
Figure 4:
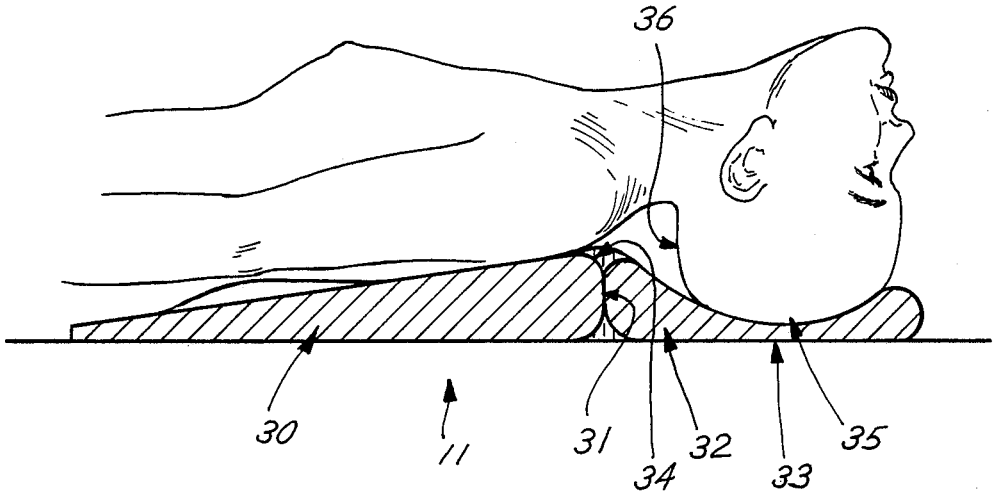
FIG. 4 is a side view of the headrest of FIG. 3 in use.

To lend stability and physical integrity to the headrest 11, connector bar 22 is interposed with two of the legs 12, the connector bar 22 having attached thereto mount 23 projecting horizontally outward for attachment to a means of body support. The body support means may include a bed, lounger, chase, table or similar apparatus for supporting an individual in the supine position. Further, the body support may be collapsible in order to facilitate transportation from one location to another and to allow for easy compact storage. The body support may also have attached thereto means for positioning the body of a person while in a supine position. This positioning means preferably comprises grips, rails, handles or the like that are attached to the body support in such a fashion as to allow a person in a supine position to change the position of their body with respect to the body support and the headrest. Further, the positioning means is also used to assist a person in attaining an upright position when in a supine position. In another embodiment, mount 23 may be engaged with track 24, as illustrated in FIG. 2, which in turn is attached to body support 25. Also illustrated in FIG. 2, headrest 11 may be conveniently stored when not in use by sliding headrest 11 along track 24 underneath body support 25.

Interposed with two of the legs 12 and parallel to frame members 15 is plate 16 having a plurality of connectors 17 attached. Connectors 17 provide a means for adjustment of head support 18. Head support 18 has two ends, one end 19 is fastened to one frame member 15 and the other end may be nonpermanently attached with a plurality of locking tabs 21 to plate 16. The locking tabs 21 and connectors 17 are designed in such a fashion to allow for interlocking of the head support 18 with plate 16, whereby the headrest is adjusted. Suitable materials of construction for head support 18 include flexible materials conformable to the shape of the crown of a head, such as leather, cloth, plastic, rubber or other like materials. The tension of head support 18 may be increased or decreased by positioning end 20 along plate 16 and then fastening locking tabs 21 to connectors 17.

Referring again to FIG. 1, the headrest may include handles 26 that assist in the positioning of the headrest to conform more comfortably to the crown of a head resting on head support 18. Handles 26 are attached to the top ends 13 of the two legs 12 that are connected to the connector bar 22, the handles 26 being aligned upwardly along the vertical axis of legs 12.

In another embodiment (FIGS. 3 and 4) headrest 11 includes body support 30 of generally triangular configuration. The body support 30 can be manufactured from a number of different materials. One of the preferred materials is urethane foam. Alternatively, the body support 30 may be a pneumatic cushion. The foam should be of sufficient density, or likewise the pneumatic cushion should be at a sufficient pressure, so that the back and shoulders of an individual utilizing headrest 11 are elevated to such a degree that allows the individual's head to be tilted backwards so the crown of the head is parallel to a horizontal plane defined by the leg opposite the hypotenuse of the triangular configuration.

Projecting outwardly from base 31 is head support 32 having concave central portion 33 located below apex 34 of the triangular configuration. The concave central portion 33 of the head support 32 must be below apex 31 in order that crown 35 of a head may be placed within the head support. If the elevation of the concave central portion were to be equal to or higher than apex 31 only back 36 of a head could be positioned within the head support, and as such not fulfill the desired reversal of gravitational forces exert on the facial tissues and muscles. The head support 32 can be constructed of similar materials as the body support 30. However, it is most preferred that the material of construction for head support 32 be more flexible and softer than the body support 30 to provide comfort and conformability to the crown of a head.

Although preferred embodiments of the invention have been described and disclosed above, it is to be remembered that various modifications can be made to the invention without departing from the true spirit and scope of the invention as defined in the appended claims.

What is claimed is:

1. A therapeutic headrest for supporting a person's head so that the gravitational forces acting on the person's facial muscles and tissues are substantially directed toward the crown of the person's head and thus are reversed from the direction that they normally act, the therapeutic headrest comprising, in combination:

means for supporting the person's body in a supine position at a first predetermined elevation, the body support means having a first edge;

means for supporting the person's head at a second predetermined elevation below said first predetermined elevation such that the person's head is extended beyond the first edge of the body support means and is supported in a position 180 degrees from the position it occupies when the person is in his or her normal upright, vertical position, with the head support means including four vertically adjustable legs each having a top end and a lengthwise adjustable bottom end, with two of the legs defining a first set of legs and with the other two of the legs defining a second set of legs, two horizontal frame members, with one of the frame members being perpendicularly attached to said top ends of the two of said adjustable legs of the first set of legs and with the other of the frame members being perpendicularly attached to said top ends of the two of the said adjustable legs of the second set of legs, and a plate interposed between two of said adjustable legs of second set of legs and parallel to said frame members, said plate including a plurality of connectors, and with the head support means being conformable to the shape of the crown of the person's head;

a connector bar interposed with two of said adjustable legs and aligned perpendicular to said horizontal frame members, said connector bar having a mount projecting horizontally for attachment to said body support, and alignment means for aligning the head support means with the body support means so as to accommodate the person.

2. A therapeutic headrest as claimed in claim 1 wherein said head support means includes a flexible sling member.

3. The headrest as claimed in claim 1, wherein said head support comprises a flexible material having two ends, a first end being fastened to one of said two frame members and a second end having a plurality of locking tabs for attachment to said connectors on said plate.

* * * * *